US005415455A

United States Patent [19]

Geldbaugh

[11] Patent Number: 5,415,455

[45] Date of Patent: May 16, 1995

[54] COLLAPSIBLE CHAIR

[76] Inventor: G. Richard Geldbaugh, 1188 Bishop St. ste 3103, Honolulu, Hi. 96813

[21] Appl. No.: 55,843

[22] Filed: May 3, 1993

[51] Int. Cl.[6] ..... A47C 4/44

[52] U.S. Cl. ..... 297/45; 297/54; 297/16.2

[58] Field of Search ..... 297/45, 54, 16.2

[56] References Cited

U.S. PATENT DOCUMENTS

| | | | |
|---|---|---|---|
| 3,228,724 | 1/1966 | Resar | 297/45 |
| 4,784,436 | 11/1988 | Sutherland | 297/45 |
| 4,889,383 | 12/1989 | Jones | 297/54 |
| 5,058,949 | 10/1991 | Von Hoffman | 297/45 |

FOREIGN PATENT DOCUMENTS

| | | | |
|---|---|---|---|
| 673237 | 10/1963 | Canada | 297/54 |
| 1135102 | 12/1956 | France | 297/54 |
| 1161907 | 3/1958 | France | 297/45 |
| 1187222 | 3/1959 | France | 297/54 |
| 1245366 | 9/1960 | France | 297/45 |
| 424573 | of 0000 | Italy | 297/45 |

*Primary Examiner*—Peter R. Brown
*Assistant Examiner*—David E. Allred
*Attorney, Agent, or Firm*—Martin E. Hsia

[57] ABSTRACT

A chair with a fabric sling backrest and seat which suspend under tension when the chair is expanded from stretcher and support tubes. The chair collapses by unlocking studs—mounted on the chair's stretcher tubes—from receiver slots, and rotating the stretcher tubes ninety degrees into one plane. The back support tubes also pivot down into the same plane. The chair then easily folds into a compact carrying size. The chair fits into a carrying bag, or alternatively, carrying straps are sewn directly onto the fabric backrest.

12 Claims, 3 Drawing Sheets

COLLAPSIBLE CHAIR

BACKGROUND —FIELD OF INVENTION

This invention relates to a collapsible chair—which when folded up becomes a small convenient package for carrying and can be readily unfolded to a usable chair without requiring assembly of separate component parts.

BACKGROUND —DESCRIPTION OF PRIOR ART

A large number of collapsible chairs are available for use by the public but unfortunately these chairs remain awkward to carry and store and often require assembly activities before the chairs can be utilized. A number of U.S. patents are pertinent to, but do not suggest the present invention. These are U.S. Pat. Nos. 4,889,383; 4,890,882; 3,285,654; 3,475,050; 3,947,903; 4,577,901; 4,61 4,377; and 5058,949.

SUMMARY OF THE INVENTION

The present invention is for a chair that can be collapsed into a compact volume that is convenient to transport and store. The principle objective of this invention is provide a chair capable of being collapsed to a convenient package for carrying and be easily unfolded for immediate use without requiring assembly of separate components. In preferred embodiments of this invention, the overall volume of, the chair is such that it can be easily inserted into a carrying bag, or has carrying straps directly attached to the chair itself for convenience of transportation.

Other objectives and advantages of this invention will herein become obvious from the following detailed description of a preferred embodiment of this invention.

DRAWING FIGURES

FIG. 1 shows a perspective drawing illustrating the chair in the expanded position for use.

FIG. 2 shows a rear view of pivoting leg connector

FIG. 3 shows a perspective drawing illustrating the chair collapsing to its compact shape, or conversely expanding for use FIG. 4 shows a perspective drawing illustrating the chair in a compacted configuration.

MODE OF OPERATIONS

Figure 2:
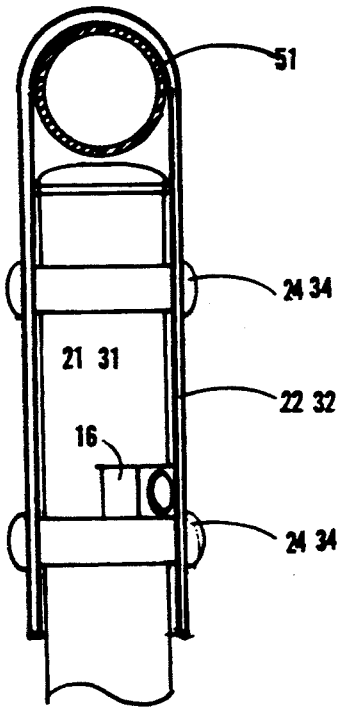
FIG. 2 illustrates the stop means 16 interfacing with the flanges of pivoting connectors 22, 32 on pivot ends of the seat support members and providing positive rotational stops. The stop means 16 also interfaces with the connector bushings 24,34 to lock the elongated stretcher tubes 21, 31 to the pivoting leg connectors 22, 32.
Figure 3:
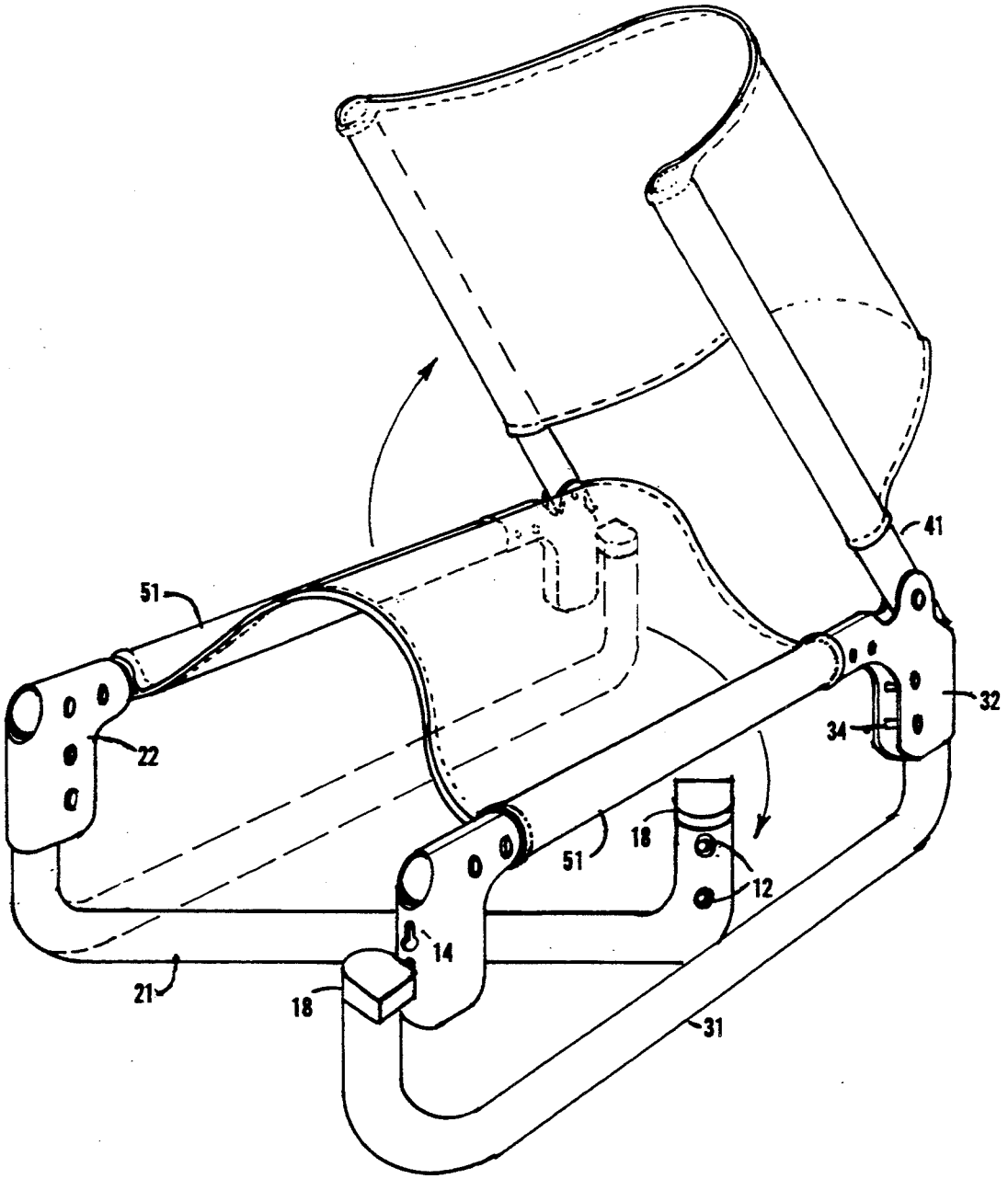
FIG. 3 illustrates the chair in a perspective view, showing the action of the components in the process of expanding the chair for use or folding the chair into a compact configuration. When folding the chair into a compact configuration, stud connectors 12 are released from the stud receiver slots 14. The front leg stretcher tube 21 and the rear leg stretcher tube 31 swivel within the front leg pivoting connector 22 and the rear leg pivoting connector 32. The front leg stretcher tube 21 and the rear leg stretcher tube 31 swivel ninety degrees to be in alignment with the seat support tubes 51 to which they are attached. The back support tubes 41 pivot downward to become parallel with the seat support tubes 51.

In the preferred embodiment of expanding the chair (as shown in FIG. 3), the front leg stretcher tube 21 and the rear leg stretcher tube 31 swivel within the leg pivoting connectors 22, 32 having a "U" shaped housing configuration, with connector bushings 34 secured through the "U" shaped housing, thereby forming a space in which the elongated stretcher tubes 21,31 swivel. Fastened to the elongated stretcher tubes 21,31 is a stop means 16 (as shown in FIG. 2) which interfaces with the connectors' "U" shape, allowing only a ninety degree movement of rotation. This stop means 16 also interfaces with connector bushings 24, 34, providing the locking mechanism necessary to restrain the tube vertically within the connector assembly, thus mounting the swivel ends of the stretcher tubes permanently yet pivotably to the pivot ends of the seat support tubes. As the elongated stretcher tubes 21, 31 swivel ninety degrees in relationship to the seat support tube 51 to which they are connected by way of the leg pivoting connectors 22, 32, the elongated stretcher tubes 21, 31 swivel into the open portion of the "U" shaped leg receiver connectors 23, 33 on the opposite sides of the chair. As the leg stretcher tube continues into the connector housing, stud connectors 12 on the leading portion of the elongated stretcher tubes 21, 31 enter into stud receiver slots 14 in the connector housing which have a narrowing interlock configuration. The stud connectors 12 protrude through the receiver slots with the heads of the studs locking into the narrow portion of the stud receiver slot 14. The endcaps 18 on the free end of the elongated stretcher tubes 21, 31 with stud connectors 12 are configured to mate with the "U" shape of the connector housing, thereby limiting rotational action. The diagonal racking action of the chair is controlled by the rotation limiting stop means 16 and by the stud connector 12 attachment as well as the configuration of the free end endcap 18 of the leg interfacing with the "U" shaped connector housing. The leg connectors 22, 23, 32, 33 are attached to the seat support tubes 51 forming a rigid connection. The rear leg connectors 32, 33 have in their upward portion, pivoting connector means for securing the first and second elongated back support tubes 41. The first and second back support tubes, each have a bottom end and a top end, pivotably connected at said bottom ends to said back support pivoting connectors so that said back support tubes can pivot between being approximately parallel to said seat support tubes 51 and an upward position. In the upward position, the bottom of the back support tube 41 bears against the endcap (not shown) of the seat support tube 51, providing a positive stop for the back support tube 41. From the back support tubes 41, a fabric sling backrest 43 is attached by wrapping the fabric around the tube and sewing the fabric to itself. From the seat support tubes 51, a fabric sling seat 53 is supported which wraps around the seat support tubes 51 and is sewn to itself.

Figure 1:
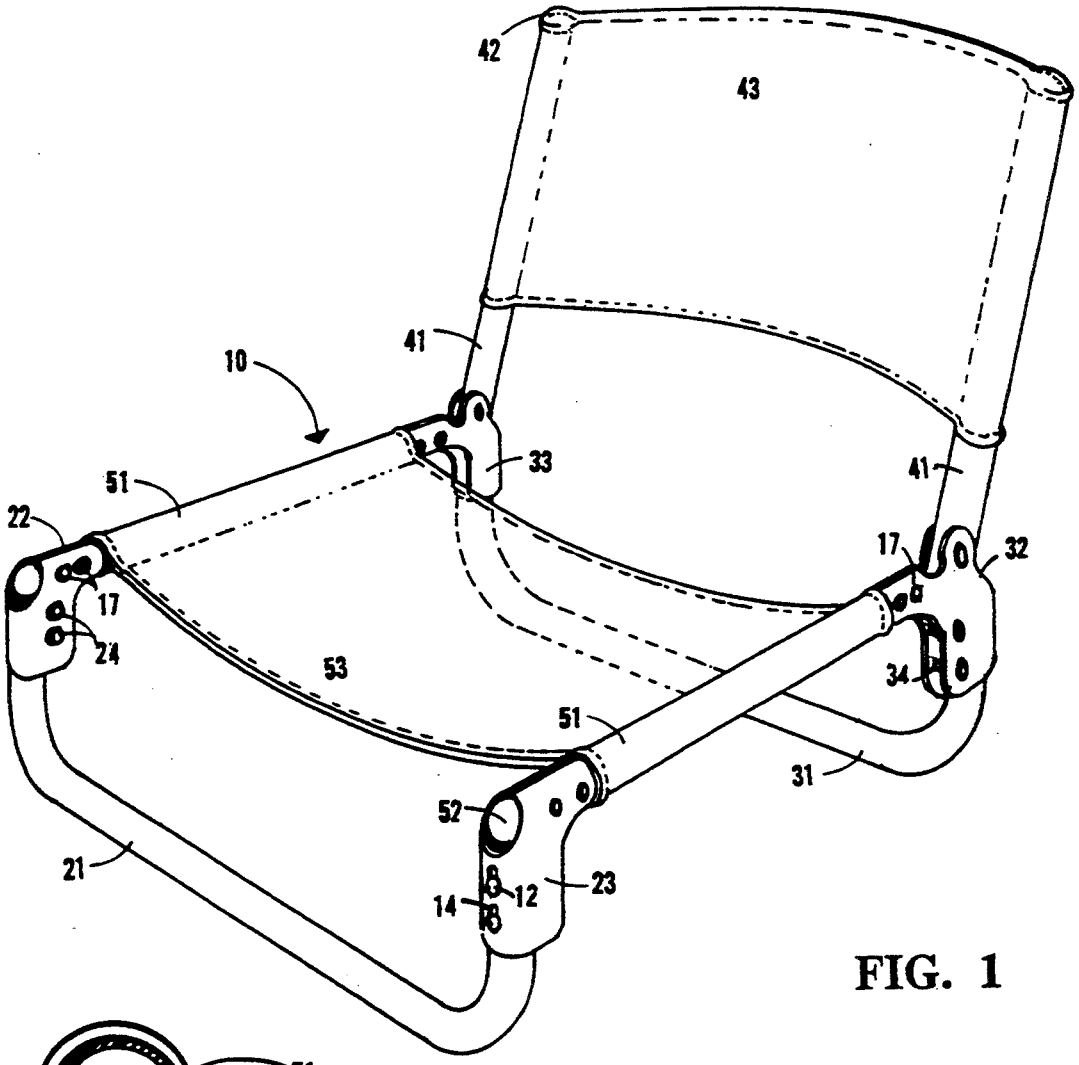
FIG. 1 shows the chair in its usable expanded position 10 with the front elongated stretcher tube 21 and the rear elongated stretcher tube 31. Each of said front and rear stretcher tubes being comprised of a combined leg stretcher portion and vertical leg portions attached to opposite ends of said horizontal stretcher portions. The front and rear stretcher tubes each have a swivel end and a free end. Said swivel ends being restrained and swiveled within the front leg pivoting connector 22 and the rear leg pivoting connector 32 to ninety degrees to the seat support tubes 51. Free ends of the front elongated stretcher tube 21 and rear elongated stretcher tube 31 are locked into position into the opposite front leg receiver connector 23 and the opposite rear leg receiver connector 33 in receiver ends of seat support tubes 51 by the stud connectors 12 and the stud receiver slots 14, forming a rigid connection. The receiver connectors are releasable connecting means. Endcaps 18 on the leg end with the stud connectors 12 are shaped to mate with "U" shaped portions of the leg receivers 23, 33. The front leg receiver connectors 22, 23 are rigidly attached to the seat support tube 51 by securement means 17. The rear leg connectors 32, 33 are also rigidly attached to the seat support tube 51 by securement means 17. The elongated back support tubes 41 with endcaps 42 are connected to the rear leg connectors 32, 33, and pivots upward providing support for the fabric sling backrest 43 which wraps around the back support tubes 41 and is sewn to itself. The seat support tubes 51, which have endcaps 52, provide support for the fabric sling seat 53 which wraps around the seat support tubes 51 and is sewn to itself. With the chair expanded, the fabric sling seat 53 and the fabric sling backrest 43 are suspended to receive weight.

In the preferred embodiment of the expanded position for the chair (as shown in FIG. 1), the front and rear elongated stretcher tubes 21, 31 have been swiveled to a position ninety degrees from the seat support tubes 51 and interlocked with the opposite leg connectors 23, 33 which creates a horizontal distance between the seat support tubes 51, thereby forming a spaced apart frame from which the fabric sling seat 53 is suspended. From this expanded frame configuration, the back support tubes 41 are pivoted upward to a substantially vertical position, thereby providing supports, spaced a chair width apart, from which a fabric sling backrest 43 is suspended.

Figure 4:
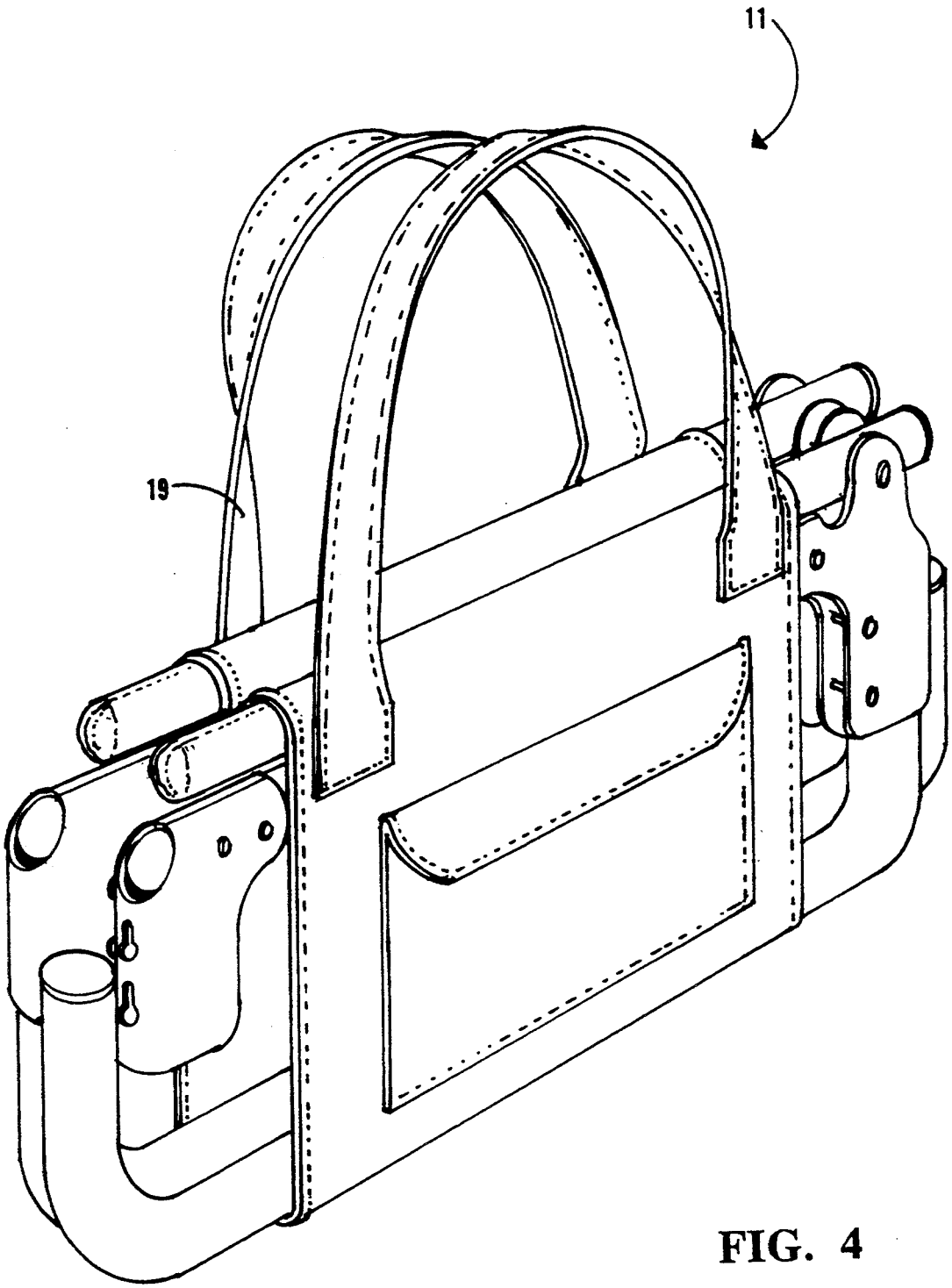
FIG. 4 illustrates, in a perspective view, the chair configured in its compacted arrangement, wherein all of the support tubes are parallel with one another. The fabric slings 43, 53 are folded so that the support tubes are closely stacked together.

In the preferred embodiment of compacting the chair (also shown in FIG. 3), the back support tubes 41 swivel about a pivot connector on the upper portion of the rear connectors 32, 33, and the back support tubes 41 swivel so that they are parallel and adjacent to the seat support tubes 51. The front leg stretcher tube 21 is then released from the stud receiver slots 14 and swivels toward the rear, ninety degrees until it is parallel with and under the seat support tubes 51 to which it is attached. The rear leg stretcher tube 31 is then released from the stud receiver slots 14 and swivels in a forward direction ninety degrees until the rear leg stretcher tube 31 is parallel with and under the seat support tube 51 to which it is attached. The stretcher portions of the stretcher tubes 21, 31 are sufficiently longer than said seat support tubes to allow said vertical leg portions adjacent to said free ends to avoid hitting said seat support tubes when said stretcher tubes are pivoted to be parallel to said seat support tubes. With the support and stretcher tubes thus aligned and parallel, the fabric sling backrest 43 and fabric sling seat 53 are wrapped around the tubes. Thus, the chair obtains a compact configuration 11 (as shown in FIG. 4), wherein the overall width of the chair in the compacted version is the width of two of connectors. For ease in carrying the compacted chair, carrying straps 19 could be incorporated into the design of the fabric sling backrest. Alternatively, the compact assembly could easily slip into a carrying bag for ease of handling.

It should now be apparent that the collapsible chair described above possesses unique attributes as set forth in the summary of the invention. Because the chair can be modified to some degree without departing from the principles as they have been outlined and explained in this specification, this invention should be understood to encompass all such modifications as fall within the scope and spirit of the following claims.

I claim:

1. A collapsible chair that can be expanded for use without assembling separate components, comprising:

first and second elongated seat support members, each having a front end and a rear end and each being of approximately the same length;

front and rear elongated stretcher members, each having a swivel end and a free end;

front leg pivoting connector means for permanently and pivotably connecting said front end of said first seat support member to said swivel end of said front stretcher member so said front stretcher member can swivel between being approximately parallel to said first seat support member and being approximately perpendicular to said first seat support member;

rear leg pivoting connector means for permanently and pivotably connecting said rear end of said second seat support member to said swivel end of said rear stretcher member so said rear stretcher member can swivel between being approximately parallel to said second seat support member and being approximately perpendicular to said second seat support member;

front leg releasable connecting means for releasably connecting said free end of said front stretcher member to said front end of said second seat support member;

rear leg releasable connecting means for releasably connecting said free end of said rear stretcher member to said rear end of said first seat support member;

sling seat means for receiving and suspending weight having first and second approximately parallel sides attached at said first side to said first seat support member and attached at said second side to said second seat support member;

whereby said seat support members and said stretcher members form a spaced apart frame when said front stretcher member is swivelled to be approximately perpendicular to said first seat support member, said free end of said front stretcher member is connected to said front end of said second seat support member, said rear stretcher member is swivelled to be approximately perpendicular to said second seat support member, and said free end of said rear stretcher member is connected to said rear end of said first seat support member; and whereby forming said spaced apart frame suspends said sling seat means between said seat support members.

2. A chair according to claim 1, further comprising:

first and second elongated back support members, each having a bottom end and a top end;

first and second back support connector means for pivotably connecting said bottom ends of said back support members to said rear ends of said seat support members so said back support members can pivot between being approximately parallel to said seat support members and an upward position; and sling backrest means for receiving and suspending weight having first and second approximately parallel sides attached at said first side to said first back support member and attached at said second side to said second back support member;

whereby forming said spaced apart frame suspends said sling backrest means between said back support members.

3. A chair according to claim 1, wherein said front leg releasable connecting means comprises front leg receiver connector means on said front end of said second seat support member for receiving said free end of said front stretcher member and stud connector means on said free end of said front stretcher member for releasably locking said free end of said front stretcher member to said front leg receiver connector means; and wherein said rear leg releasable connecting means comprises a rear leg receiver connector means for receiving said free end of said rear stretcher member on said rear end of said first seat support member and stud connector means on said free end of said rear stretcher member for releasably locking said free end of said rear stretcher member to said rear leg receiver connector means.

4. A chair according to claim 1, wherein said seat support members comprise hollow tubes.

5. A chair according to claim 1, wherein said stretcher members comprise hollow tubes.

6. A chair according to claim 1, wherein said back support members comprise hollow tubes.

7. A collapsible chair that can be expanded for use without assembling separate components, comprising:

first and second elongated seat support tubes, each having a front end and a rear end and each being of approximately the same length;

a front leg pivoting connector on said front end of said first seat support tube;

a rear leg receiver connector having a back support pivoting connector on an upward portion, on said rear end of said first seat support tube;

a front leg receiver connector on said front end of said second seat support tube;

a rear leg pivoting connector having a back support pivoting connector on an upward portion, on said rear end of said second seat support tube;

an front elongated front stretcher tube having a swivel end and a free end, said swivel end of said front stretcher tube being connected by front leg pivoting connector means for restraining said front stretcher tube so that said front stretcher tube can swivel between being approximately parallel to said first seat support tube and being approximately perpendicular to said first seat support tube;

a rear elongated stretcher tube having a swivel end and a free end, said swivel end of said rear stretcher tube being connected by leg pivoting connector means for restraining said rear stretcher tube so that said rear stretcher tube can swivel between being approximately parallel to said second seat support tube and being approximately perpendicular to said second seat support tube;

stud connectors mounted on said free ends of said stretcher tubes;

first and second elongated back support tubes, each having a bottom end and a top end, pivotably connected at said bottom ends to said back support pivoting connectors so that said back support tubes can pivot between being approximately parallel to said seat support tubes and an upward position;

a fabric sling seat having first and second approximately parallel sides attached at said first side to said first seat support tube and attached at said second side to said second seat support tube; and a fabric sling backrest having first and second approximately parallel sides attached at said first side to said first back support tube and attached at said second side to said second back support tube;

whereby swivelling said front stretcher tube to be approximately perpendicular to said first seat support tube, engaging said stud connectors on said free end of said front stretcher tube with said front receiver connector, swivelling said rear stretcher tube to be approximately perpendicular to said second seat support tube, and engaging said stud connectors on said free end of said rear stretcher tube with said rear receiver connector, forms a spaced apart frame, suspends said fabric sling seat between said seat support tubes, and suspends said fabric sling backrest between said back support tubes.

8. A chair according to claim 7, wherein each of said stretcher tubes comprises:

a combined leg and stretcher structure comprising a horizontal stretcher portion and vertical leg portions attached to opposite ends of said horizontal stretcher portion.

9. A chair according to claim 8, wherein said stretcher portions are sufficiently longer than said seat support tubes to allow said vertical leg portions adjacent to said free ends to avoid hitting said seat support tubes when said stretcher tubes are pivoted to be parallel to said seat support tubes.

10. A chair according to claim 7, further comprising:

rotational stop means mounted adjacent to said pivot ends of said stretcher tubes for limiting pivoting of said stretcher tubes to ninety degrees from said seat support tubes.

11. A chair according to claim 10, wherein said leg pivoting connectors comprise U shaped housings having connector bushings defining a space within which said stretcher tubes swivel, whereby said stop means vertically restrain said stretcher tubes in said housings.

12. A collapsible chair that can be expanded for use without assembling separate components, comprising:

first and second elongated seat support members, each having a receiver end and a pivot end;

front and rear elongated stretcher members, each having a swivel end and a free end, and each permanently and pivotably mounted at said swivel end to a pivot end of a corresponding seat support member;

sling seat means having two approximately parallel edges attached at said edges to said support members so that said receiver end of said first seat support member is laterally opposite said pivot end of said second seat support member and said pivot end of said first seat support member is laterally opposite said receiver end of said second seat support member; and releasable connecting means for releasably connecting said free ends of said stretcher members to said receiver ends of said laterally opposite seat support members;

whereby swivelling said stretcher members to be approximately perpendicular to said seat support members and releasably connecting said free ends of said stretcher members to said laterally opposite receiver ends of said seat support members using said releasable connecting means forms a spaced apart frame and suspends said sling seat means between said seat support members.

* * * * *